United States Patent [19]

Leuthard

[11] 4,324,207

[45] Apr. 13, 1982

[54] ENERGY EFFICIENT WATER HEATER

[76] Inventor: John E. Leuthard, 8735 Penn Ave. South, Minneapolis, Minn. 55431

[21] Appl. No.: 172,088

[22] Filed: Jul. 25, 1980

[51] Int. Cl.[3] ..... F22B 37/42

[52] U.S. Cl. ..... 122/448 B; 122/14; 126/374

[58] Field of Search ..... 122/13 R, 13 A, 14, 122/448 B; 126/361, 374; 219/314; 236/1 E, 20 R

[56] References Cited

U.S. PATENT DOCUMENTS

| | | | |
|---|---|---|---|
| 2,352,919 | 7/1944 | Stack | 122/14 |
| 2,522,091 | 9/1950 | Burwell | 122/14 |
| 2,834,865 | 5/1958 | Coates | 219/38 |
| 3,383,495 | 5/1968 | Laube et al. | 219/314 X |
| 3,484,580 | 12/1969 | Morgan | 219/314 |
| 3,964,466 | 6/1976 | Ohringer | 122/448 B X |
| 4,140,104 | 2/1979 | Itagaki | 126/374 |
| 4,246,764 | 1/1981 | Papadakus | 126/374 X |

*Primary Examiner*—Edward G. Favors

*Attorney, Agent, or Firm*—Paul L. Sjoquist

[57] ABSTRACT

Apparatus is disclosed for heating hot water in separate tank stages, and according to predetermined cyclic time patterns. A first smaller hot water tank is heated to a first elevated temperature under thermostatic control, and a second larger hot water tank is heated to a second lower temperature under thermostatic control and to a third elevated temperature under thermostatic control during a predetermined time cycle; provision is made for demand override of the heating mechanism of the second tank.

10 Claims, 3 Drawing Figures

ENERGY EFFICIENT WATER HEATER

BACKGROUND OF THE INVENTION

This invention relates to an energy efficient hot water heater system, and more particularly to a hot water heating system having a first low capacity tank for intermittent heating requirements and a second larger tank for periodic heavy demand heating requirements.

It is generally accepted that a water heater is normally the second largest household energy consumer; normal living patterns in typical American households consume significant quantities of hot water each day. For example, it has been estimated that a family of four uses an average of 100 gallons of hot water per day. The operation of the modern automatic clothes washer consumes from 10–18 gallons of hot water for each load of clothing that it handles, and a typical automatic dishwasher uses 8–14 gallons of hot water each day. The use of a bathtub requires 10–15 gallons of hot water, and a shower requires from 8–12 gallons of hot water. The typical hot water heater in an American home is a tank having a 30–40 gallon capacity, and normal usage requirements result in the heating and replacing of the entire tank volume from three to four times per day. Hot water heaters are typically designed to maintain water temperature at a temperature of 120° F. 130° F., and prior art hot water heaters required the entire water tank capacity to be heated to this temperature for 24 hours per day.

The amount of normal heat loss from a hot water tank ranges from 25–35 percent of the heat capacity of the water stored within the tank. This typically increases the cost of operation of the hot water system up to 35 percent, because of the additional heat which must be applied to the system in order to maintain the water temperature at a desired setting even during periods of nonuse. A simple timing mechanism attached to a conventional hot water heater which limits the heating cycle to roughly 12 hours per day, and which permits the water temperature to gradually cool during the off cycle time of the water heater, will itself reduce significantly the energy consumption of a hot water system. However, this approach suffers the disadvantage that, since the heating system is totally disabled during approximately one half the day, the system is incapable of adequately providing for intermittent hot water demand during the off-cycle time.

The present invention overcomes this problem by providing for intermittent heating demand needs while preserving the maximum heating capacity for periodic heavy demand intervals.

SUMMARY OF THE INVENTION

The invention comprises a first hot water tank of relatively low volume capacity, operable under thermostatic control to provide intermittent demand heating requirements; a second larger volume capacity heating tank operable under a timed thermostatic control to provide a reserve of tepid water and to provide a full volume capacity of hot water during heavy demand time intervals. In an alternative embodiment of the invention, an automatic or manual demand override is provided to meet non-predicted heavy uses of hot water, and to cause the larger hot water tank to provide supplementary heating during such periods.

It is a principal object of the present invention to provide a hot water heating system having a first capacity for intermittent heating needs, and a second capacity for periodic heavy demand needs.

It is a further object of the present invention to provide a reserve supply of warm water which may be relatively quickly elevated in temperature to meet intermittent demand needs.

It is another object of the present invention to provide a hot water heating system to meet both intermittent and heavy demand heating needs with a minimum loss of heating energy.

BRIEF DESCRIPTION OF THE DRAWINGS

The aforementioned and other objects of the invention will be understood from the following detailed description of the invention, and with reference to the appended drawings, in which.

DESCRIPTION OF THE PREFERRED EMBODIMENT

Figure 1:
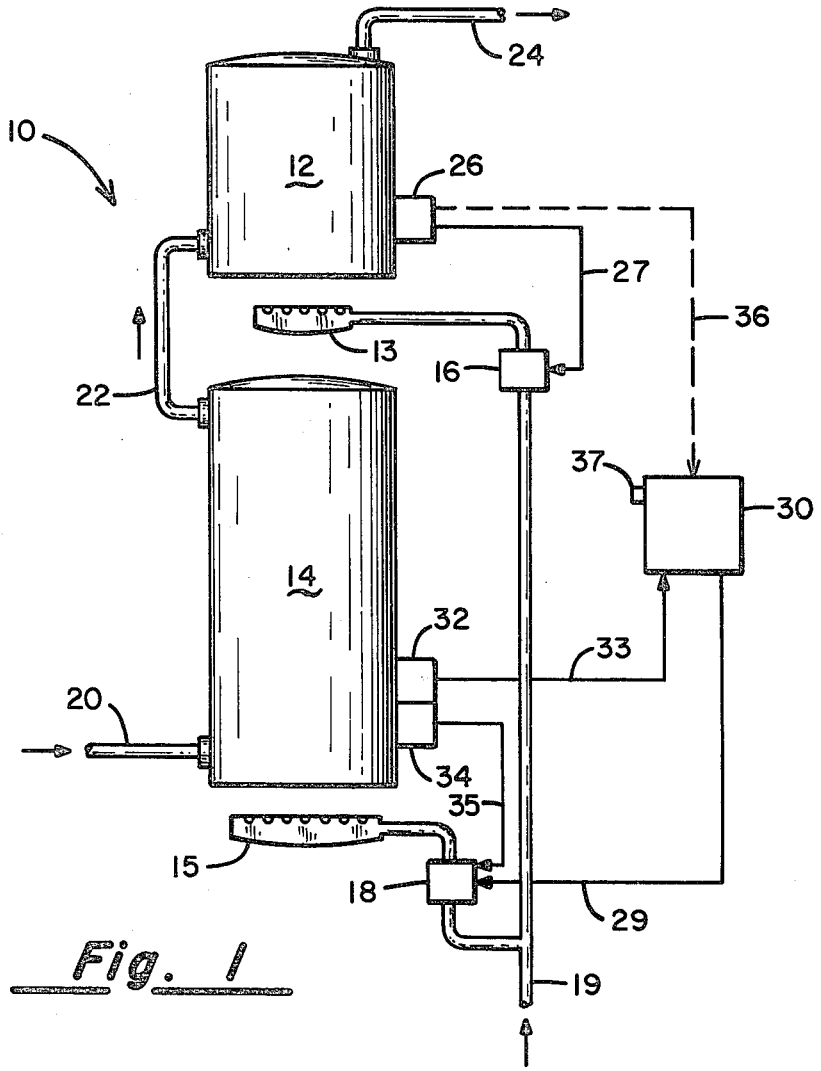
FIG. 1 shows a symbolic diagram of the invention.

Referring first to FIG. 1, there is shown a hot water heating system 10 in symbolic and schematic illustration. A first hot water tank 12 has a capacity of about 10 gallons, and a second hot water tank 14 has a capacity of about 30 gallons. A first heater 13 provides heat energy for heating the water in tank 12, and a second heater 15 provides heat energy for heating the water in tank 14. Heaters 13 and 15 may be gas or oil burners, electric heating elements, or any other conventional form of heater. For purposes of illustration and explanation herein they are referred to as gas-operated heating elements.

A cold water inlet pipe 20 provides a supply of water to tank 14, which is received from conventional water systems such as a well or water main. The temperature of the water provided by inlet pipe 20 is typically in the range of 45–60° F. A coupling water pipe 22 interconnects tanks 14 and 12, serving as a warm water outlet from tank 14 and a cold water inlet to tank 12. A hot water outlet pipe 24 is connected to tank 12, and may be connected to all of the hot water pipes within the structure of interest. In all cases, the direction of water flow through the system is as shown by the arrows.

The supply of fuel into heater 13 is controlled by a valve 16, and the supply of fuel into heater 15 is controlled by a valve 18. Valves 16 and 18 are conventional in design, commonly connected to a fuel line 19 which, by way of example, may be a natural gas line.

The operation of valve 16 is controlled by a thermostat 26 which senses the temperature of the water inside of tank 12. A control line 27 is connected between thermostat 26 and valve 16, which control line 27 energizes valve 16 to provide fuel to heater 13 at a preset lower temperature setting of thermostat 26, and deenergizes valve 16 to shut off the flow of fuel to heater 13 at a preset upper temperature limit of thermostat 26. Thermostat 26 may typically be operated in the range of 120° F.–130° F., with an upper limit of about 160° F., although it is preferable that thermostat 26 be manually adjustable to any desired water temperature in the range of 110° F.–160° F. The combination of thermostat 26 and valve 16 may be similar to the conventional water heater control system found in prior art water heaters.

The supply of fuel to burner 15 is controlled by valve 18, which is in turn controlled by a signal on line 35 or line 29, Line 29 is energized and deenergized by control box 30, which contains conventional switches and a clock mechanism. A thermostat 32 is electrically connected to control box 30 by line 33; a thermostat 34 is connected to valve 18 by line 35. Thermostats 32 and 34 respectively sense the water temperature within tank 14, and each of them may be preset to become activated over predetermined temperature ranges. For example, thermostat 32 may be set to provide a first signal on line 33 at a water temperature of about 130° F., and to provide a second signal at a water temperature of about 110° F. Thermostat 34 may be set to provide a first signal on line 35 at a water temperature of about 110° F., and a second signal at a water temperature of about 70° F. The thermostat control signal on line 33 is regulated by a clock timer in control box 30, so as to permit thermostat 32 to be connected in control relationship to line 29. Control box 30 therefore permits an elevated temperature thermostatic control to operate tank 14 during a predetermined time interval.

An alternative and override signal may be provided by means of line 36. Line 36 becomes energized at a predetermined low temperature setting of thermostat 26, and when energized causes an override signal to couple thermostat 32 directly to line 29, bypassing the clock timer. In this manner, line 36 may be used to detect heavy demand from tank 12, which demand causes the temperature of water in tank 12 to drop below a predetermined limit, and to thereby override the normal control sequence for tank 14 to cause tank 14 to immediately begin heating to supplement the water in tank 12. The components used in control box 30 may be of conventional design, and may include switches and clock timers which are readily available in the industrial control field.

A manual override signal may be provided by means of switch 37, which may be manually activated to couple thermostat 32 directly to line 29, thereby bypassing the clock timer.

Figure 3:
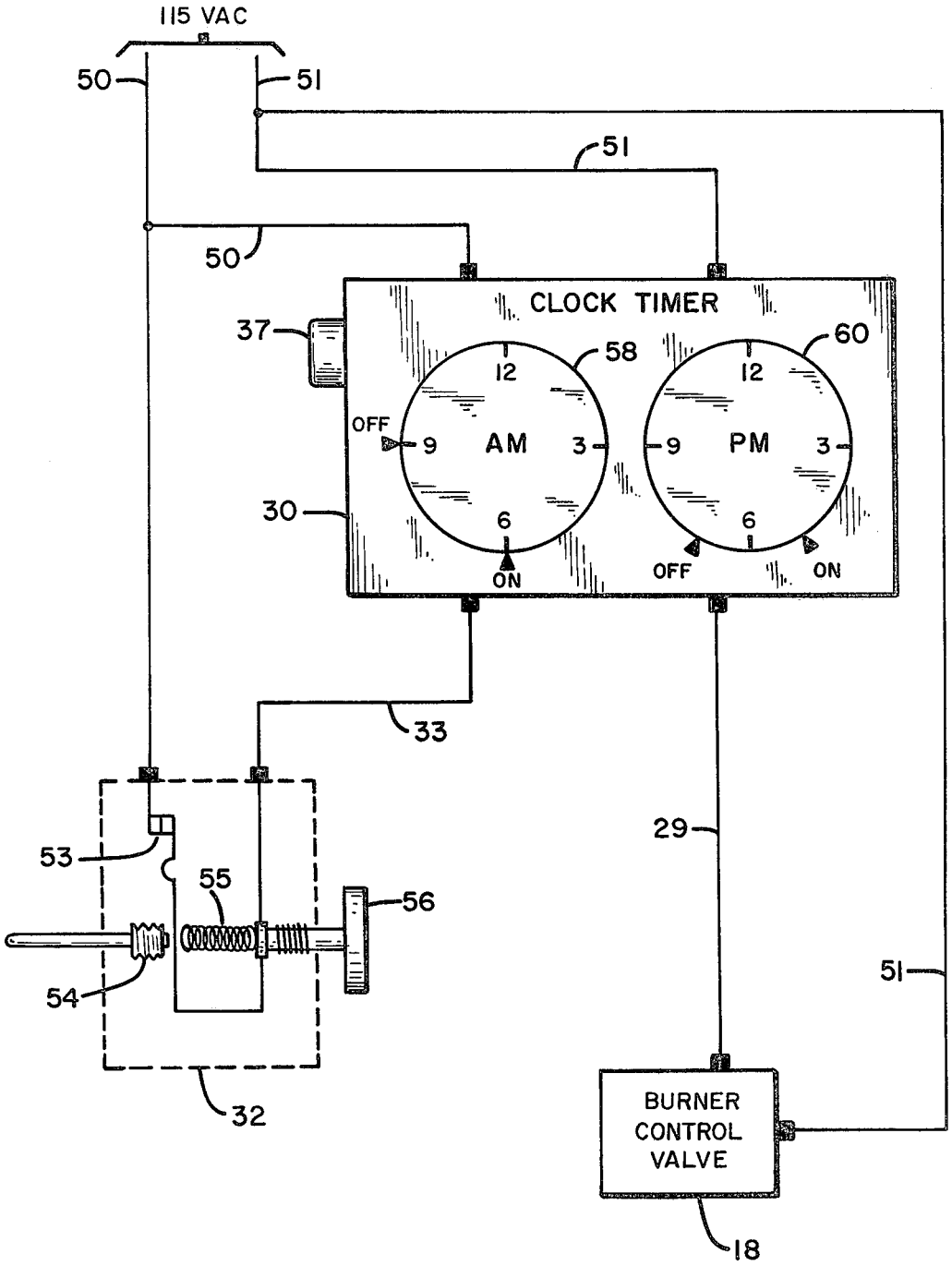
FIG. 3 shows the timing and thermostatic mechanism.

FIG. 3 shows the timing and thermostatic mechanism in symbolic and schematic form. A conventional alternating current power source is coupled to control box 30 via lines 50 and 51. This power is used to operate the clock timing mechanism as well as to energize valve 18 as will hereinafter be described. Thermostat 32 is connected to line 50 through normally closed switch contacts 53. Switch contacts 53 are opened at a predetermined temperature within tank 14 by control bellows 54, which operates against spring 55. Knob 56 may be adjusted to vary the spring force of spring 55, and thereby to control to temperature of tank 14 at which switch contacts 53 open. When switch contacts 53 are closed the voltage on line 50 is applied to line 33 and thereby to control box 30.

Line 33 is internally connected in control box 30 through the parallel combination of switch 37, timer switch 58, and timer switch 60, to line 29. Thus line 29 becomes energized with the voltage of line 50 whenever the thermostatic switch contacts 53 are closed, and any of the following additional events occur:

a. manual switch 37 is activated;
b. timer switch 58 is activated; or
c. timer switch 60 is activated. Timer switches 58 and 60 may be activated by setting appropriate "on" and "off" tabs at selected time intervals in a manner which is conventional with timing devices of this type.

Figure 2:
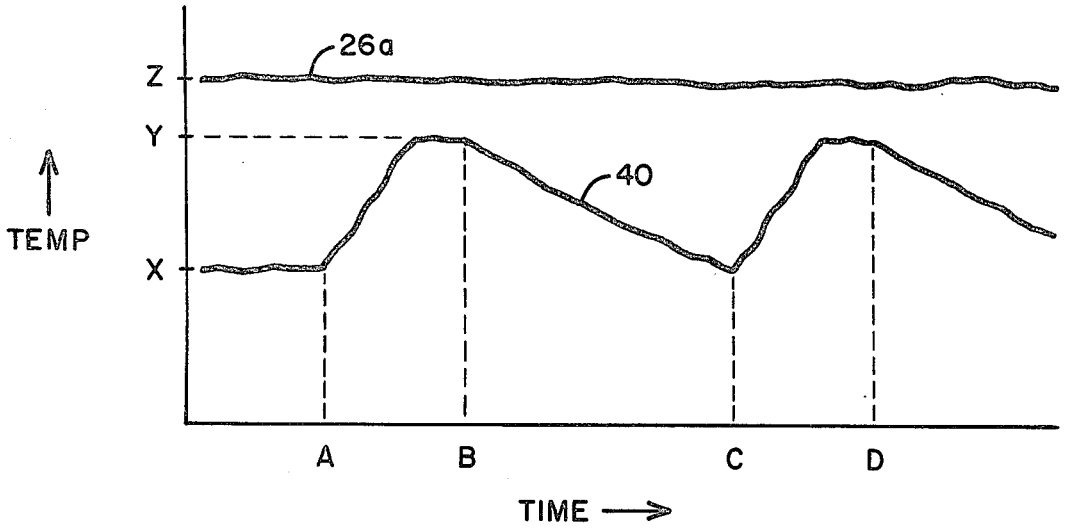
FIG. 2 is a graph showing the operation of the invention.

FIG. 2 illustrates a graph showing the typical timing operation of the invention. The horizontal axis of FIG. 2 is representative of time, and may represent a typical 24 hour day. The vertical axis of FIG. 2 is representative of temperature, and may represent typically the temperature of 0° F.–160° F. Line 26*a* represents the relatively constant temperature "Z" which is provided to the water within tank 12 by thermostat 26. Under normal use conditions thermostat 26 will maintain the temperature of the water in tank 12 at a temperature "Z", which may be for example in the range of 120° F.–130° F. Line 40 represents the typical temperature conditions in tank 14 at different times during a 24 hour period. Tank 14 is initially controlled at a temperature "X", provided by thermostat 34, which temperature may be in the range of 70° F.–100° F. At a preset time "A", control box 30 switches thermostat 32 into a controlling relationship to valve 18, thereby permitting tank 14 to begin heating to the higher temperature setting "Y" of thermostat 32. The temperature of tank 14 remains under the control of thermostat 32, typically at about 110° F.–130° F., until time "B", which is presumed to be the end of the peak demand for hot water from the system. At time "B" and thereafter, control box 30 switches thermostat 32 out of controlling relationship to valve 18, and thereby back to the lower temperature thermostat, permitting the temperature within tank 14 to gradually become lowered to temperature "X". At time "C" the cycle again repeats itself and control box 30 again switches to the higher temperature thermostat 32. This higher temperature control setting continues until time "D", at which time it again returns to the control of the lower temperature thermostat 34. The temperature cycling of tank 14 is illustrated to occur twice during each 24 hour period, although other and further combinations of thermostatic coupling could be achieved by proper selection of the timing mechanism within control box 30. However, it is known that in a typical residential home the hot water demands peak during the early morning wake up hours and again peak during the early evening hours, and it is therefore believed that the operational embodiment described herein is preferred for most uses.

The apparatus shown in FIG. 1 may be enclosed in a cylindrical cover having suitable insulation around tanks 12 and 14 to minimize heat loss therefrom. The burned fuel from heaters 13 and 15 may be collected in a conventional manner by means of a smoke stack which may be mounted above the housing enclosing tanks 12 and 14.

In operation, thermostat 26 is set to the desired hot water temperature setting to be delivered by the system. The timer in control box 30 is adjusted to provide elevated temperature control of tank 14 during the presumed peak demand intervals. Thermostats 32 and 34 are each set for a low temperature warming setting and a higher temperature peak load setting. The preferable low temperature setting is in the range of 70° F.–110° F., and the preferable higher temperature setting for tank 14 is about 120° F. The presumed peak demand periods may be between the hours of 6:00 A.M. and 9:00 A.M., and 5:00 P.M.–7:00 P.M. The timing mechanism within control box 30 should be set to permit heater 15 to turn on early enough to provide peak demand hot water from tank 14 during the actual peak demand hours.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. Apparatus for heating hot water according to predetermined quantity and time allotments, comprising:

(a) a first water tank and heater coupled to a water source;

(b) first and second thermostats for sensing water temperature in said first water tank;

(c) a second water tank and heater coupled to said first water tank, and having a hot water outlet;

(d) third thermostat for sensing water temperature in said second water tank;

(e) first and second means for respectively energizing said first and second heaters;

(f) means for coupling said third thermostat to said second means for energizing, for controlling said second heater in response to said third thermostat; and (g) a control network having timing means therein, coupled to said first thermostat and to said means for energizing said first heater, whereby said first thermostat controls said first heater during a first time interval and said second thermostat controls said first heater during a second time interval.

2. The apparatus of claim 1, further comprising means coupling said third thermostat to said means for energizing said first heater at a predetermined setting of the third thermostat.

3. The apparatus of claim 1, further comprising means for manually coupling said first thermostat to said means for energizing said first heater.

4. The apparatus of claim 1, wherein said second water tank is coupled to said first water tank to receive the warmest water from said first water tank.

5. The apparatus of claim 1, wherein said first and second heaters further comprise burners, and said first and second means for energizing further comprise valves.

6. The apparatus of claim 1, wherein said third thermostat operates in the range of 110° F. to 160° F.

7. The apparatus of claim 6, wherein said second thermostat operates in the range of 70° F. to 110° F.

8. The apparatus of claim 7, wherein said first thermostat operates in the range of 110° F. to 160° F.

9. The apparatus of claim 8, wherein said timing means further comprises a 24-hour clock.

10. The apparatus of claim 1, wherein the ratio of volume capacity of said first tank and said second tank is approximately 3:1.

* * * * *